US005190287A

United States Patent [19]

Ishiyama

[11] Patent Number: 5,190,287

[45] Date of Patent: Mar. 2, 1993

[54] JIGSAW PUZZLE TOY USING BLOCKS

[75] Inventor: Shozo Ishiyama, Tokyo, Japan

[73] Assignee: Kabushiki Kaisha Gakushu Kenkyusha, Tokyo, Japan

[21] Appl. No.: 799,337

[22] Filed: Nov. 27, 1991

[30] Foreign Application Priority Data

Nov. 27, 1990 [JP] Japan ..... 2-327191

[51] Int. Cl.[5] ..... A63F 9/12

[52] U.S. Cl. ..... 273/156; 434/403; 273/157 R

[58] Field of Search ..... 273/156, 157 R, 153 P; 434/259, 327, 339, 346, 348, 403, 406, 407; 446/117, 118, 124, 125, 69; 206/499, 500, 505

[56] References Cited

U.S. PATENT DOCUMENTS

| | | | |
|---|---|---|---|
| 1,472,536 | 10/1923 | Thomson | 446/117 |
| 2,416,959 | 3/1947 | Segal | 434/259 |
| 2,875,531 | 3/1989 | Mansfield | 434/406 |
| 2,923,551 | 2/1960 | Pope | 273/160 |
| 2,963,796 | 12/1960 | Zalkind | 446/125 |
| 3,375,009 | 3/1968 | Stubbmann et al. | 273/156 |
| 3,630,527 | 12/1971 | Breslow | 273/157 R |
| 4,286,952 | 9/1981 | Roche | 273/156 |
| 4,437,668 | 3/1984 | Simpson et al. | 273/156 |
| 4,494,935 | 1/1985 | Miller | 273/157 R |
| 4,604,073 | 8/1986 | Livesey et al. | 446/117 |
| 4,698,023 | 10/1987 | Marino | 434/259 |
| 4,822,051 | 4/1985 | Nowak et al. | 273/157 R |
| 4,986,789 | 1/1991 | Hang | 434/259 |
| 5,035,666 | 7/1991 | Kang | 446/69 |

FOREIGN PATENT DOCUMENTS

| | | | |
|---|---|---|---|
| 60-94288 | 6/1985 | Japan . | |
| 12963 | of 1903 | United Kingdom | 434/230 |

*Primary Examiner*—V. Millin
*Assistant Examiner*—Steven B. Wong
*Attorney, Agent, or Firm*—Howard L. Rose

[57] ABSTRACT

A jigsaw puzzle toy has a board (2) with a recess (5) defined in its upper surface. The jigsaw puzzle toy includes a plurality of first projections (19) projecting on the upper surface of the board and having first shapes, respectively, when viewed in plan, a plurality of first blocks (23) having respective holes (31) defined in surfaces thereof and having respective shapes complementary to the first shapes of the first projections (19) for fitting engagement therewith, and respective cavities (29) defined in other surfaces thereof and having respective second shapes, respectively, when viewed in plan; and a plurality of second blocks (37) having respective shapes complementary to the second shapes, respectively, when viewed in plan, for fitting engagement in the cavities (29), respectively, of the first blocks. The second blocks (37) have respective second projections (39) having the first shapes, respectively. The first projections (19) are vertically movable downwardly, and positioned above sound generating units (50, 60) that produce sounds when the first projections (19) are moved downwardly. The first blocks (23) can be fitted in the recess (5) of the board (2).

11 Claims, 5 Drawing Sheets

JIGSAW PUZZLE TOY USING BLOCKS

BACKGROUND OF THE INVENTION

1. Field of the Invention

The present invention relates to a toy in the form of a jigsaw puzzle, and more particularly to a jigsaw puzzle toy which is easy for infants to play with, the jigsaw puzzle toy being composed of blocks that fit together.

2. Description of the Relevant Art

Jigsaw puzzles that are commercially available today comprise a number of differently shaped small pieces having convex and concave outer edges. The player combines the pieces together on a trial-and-error basis until they fit completely together in a predetermined combination within a recessed area on the upper surface of a main board surrounded by a peripheral frame. When the pieces are fully put together within the frame, the pieces and the frame jointly make up a given graphic pattern.

The player of a conventional jigsaw puzzle plays with the puzzle simply by fitting the pieces together in the recessed area until the final combination is reached. Once the desired combination is completed, the player often loses interest in building the puzzle again and gets bored with the jigsaw puzzle that he has played with.

SUMMARY OF THE INVENTION

It is an object of the present invention to provide a jigsaw puzzle toy which can easily be played with in a variety of different ways.

According to the present invention, there is provided a jigsaw puzzle toy including a board, a plurality of first projections projecting on an upper surface of the board and having first shapes, respectively, when viewed in plan, a plurality of first blocks having respective holes defined in surfaces thereof and having respective shapes complementary to the first shapes of the first projections for fitting engagement therewith, and respective cavities defined in other surfaces thereof and having respective second shapes, respectively, when viewed in plan, and a plurality of second blocks having respective shapes complementary to the second shapes, respectively, when viewed in plan, for fitting engagement in the cavities, respectively, of the first blocks.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
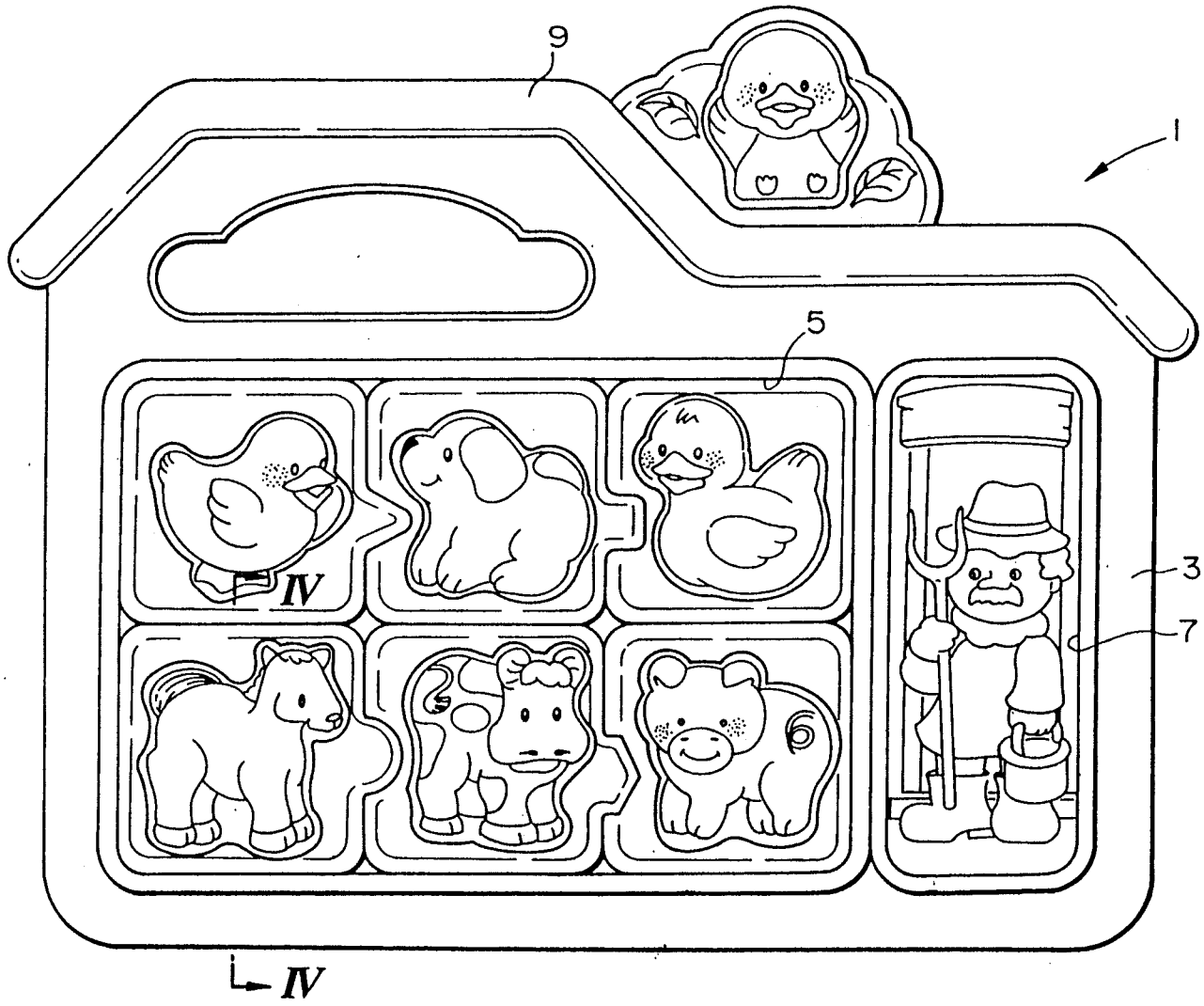
FIG. 1 is a plan view of a jigsaw puzzle toy according to the present invention.

FIG. 1 shows a jigsaw puzzle toy according to the present invention. The jigsaw puzzle toy 1 includes a game board 2 (see FIG. 4) having an upper plate 3 with rectangular recesses 5, 7 defined therein. The rectangular recesses 5, 7 are surrounded by raised ridges 8 and spaced inwardly from the outer peripheral edges of the upper plate 3. The jigsaw puzzle toy also includes a roof member 9 held against an upper edge of the upper plate 9. The upper plate 3 and the roof member 9 are jointly shaped like a stable or similar farm building in the illustrated embodiment.

Figure 2:
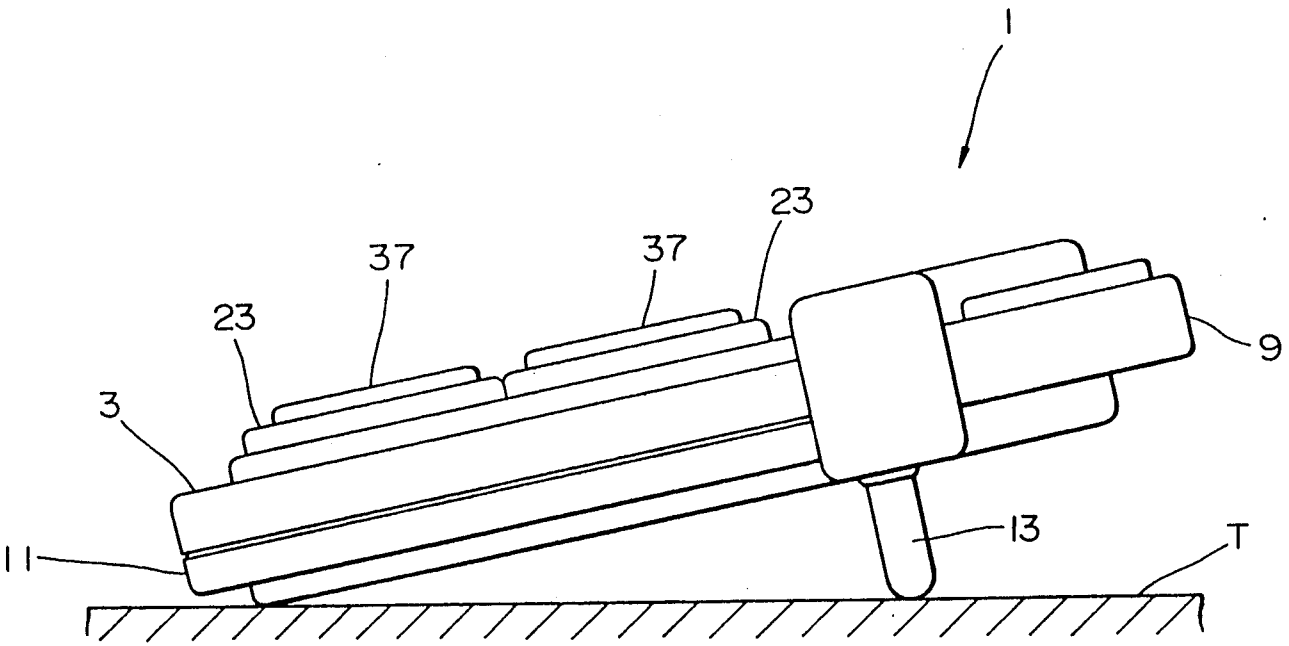
FIG. 2 is side elevational view of the jigsaw puzzle toy that is placed on a base.

The game board 2 also includes a base plate 11 (see FIG. 3) to which the upper plate 3 is fastened with screws or the like. A pair of detachable legs 13 is attached to the reverse side of the base plate 11 near the roof member 9, so that when the game board 2 is placed on a flat base T (FIG. 2), the game board 2 is inclined for the player to look at and play with easily.

Figure 3:
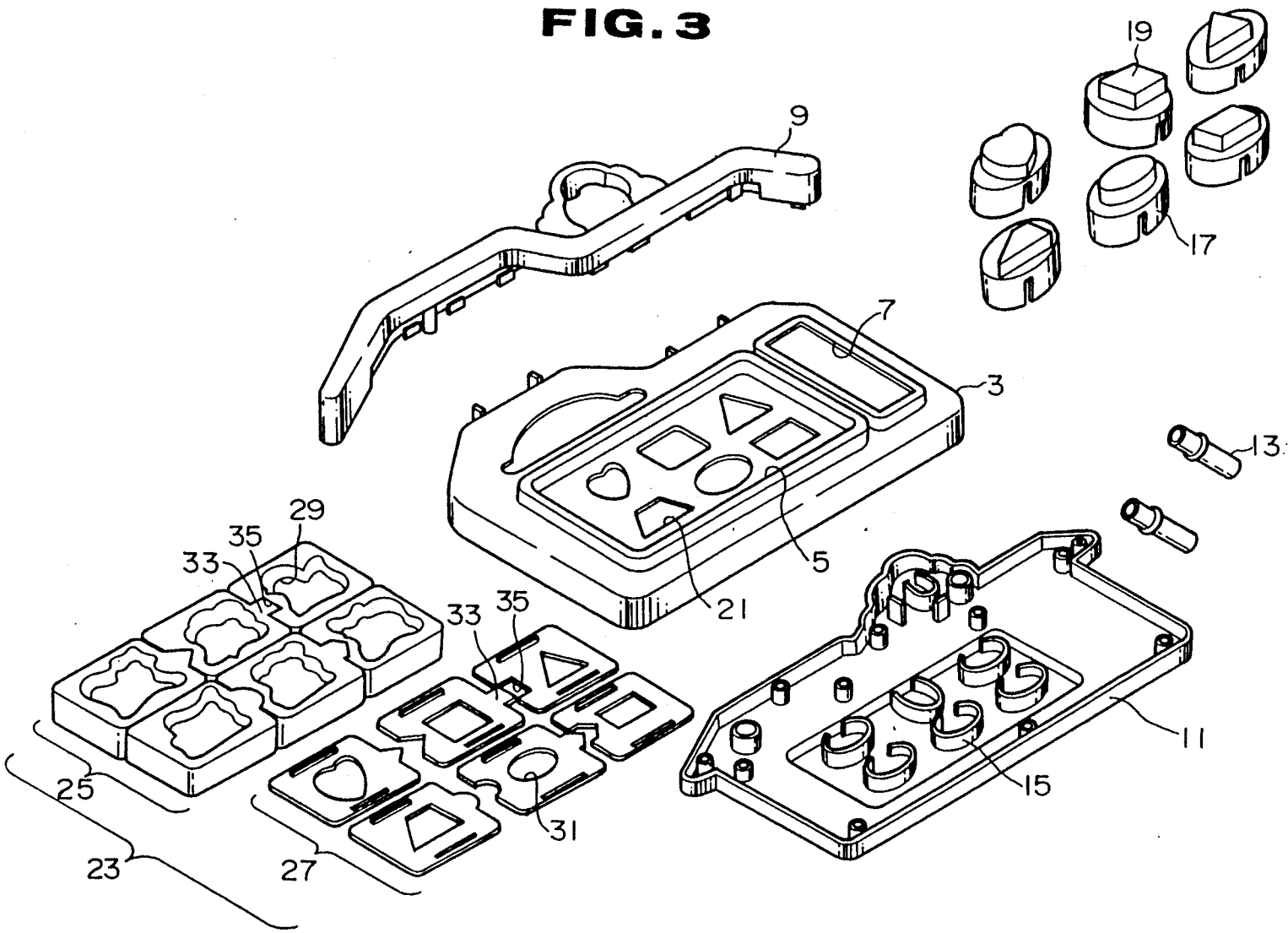
FIG. 3 is an exploded perspective view of the jigsaw puzzle toy.
Figure 5:
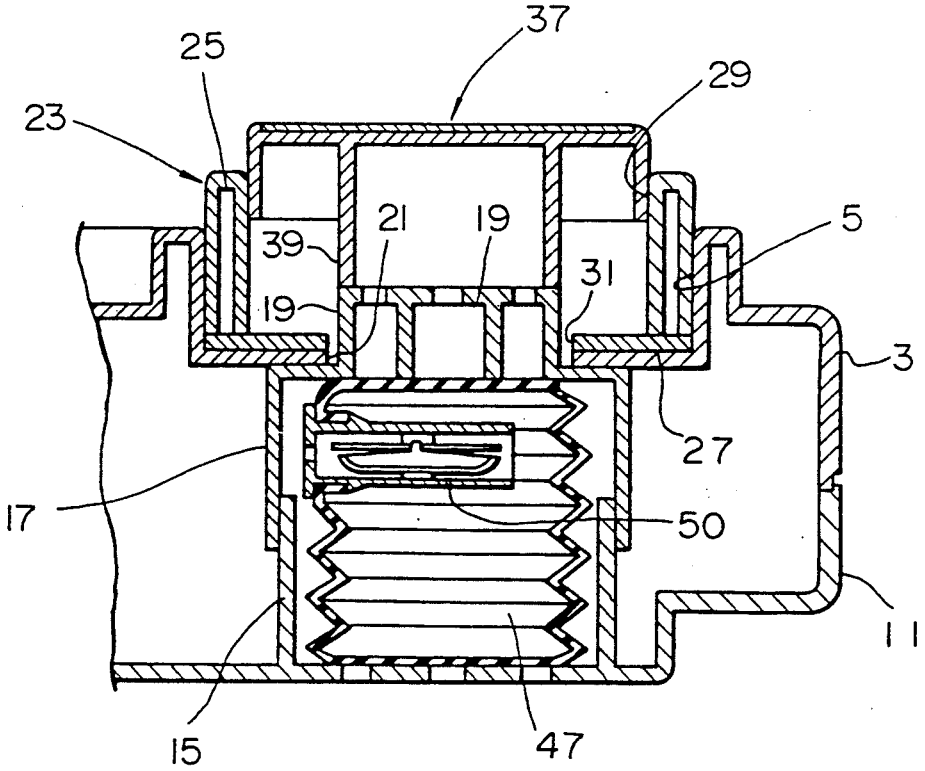
FIG. 5 is an enlarged cross-sectional view taken along line V—V of FIG. 1.

In FIG. 3, the base plate 11 has six short guide frames 15 projecting upwardly from its upper surface. As shown in FIG. 5, each of the guide frames 15 houses therein a resilient bellows 47 that is normally in an expanded state and can be manually compressed downwardly. The bellows 47 supports on its upper end a whistle 50 connected to the bellows 47 so that when the bellows 47 is compressed downwardly and extended upwardly, the whistle 50 produces a sound.

Figure 4:
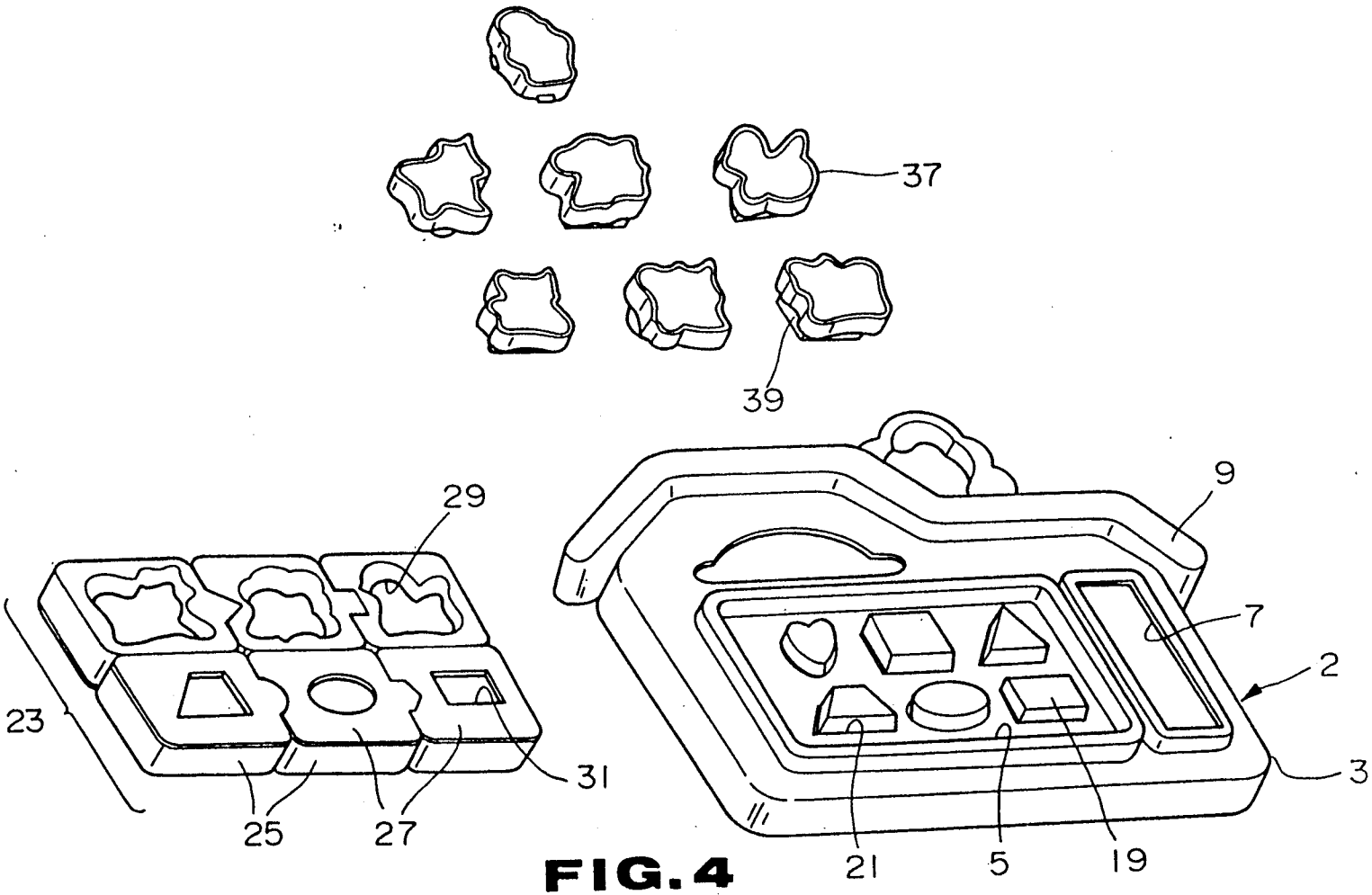
FIG. 4 is an exploded perspective view showing a game board, rectangular blocks, and figure blocks of the jigsaw puzzle toy.

Tubular movable members 17 (see FIGS. 3 and 5) are vertically movably fitted over the respective guide frames 15, and are supported on the bellows 47 between the upper plate 3 and the base plate 11. The tubular movable members 17 have respective lands 19 on their upper ends, the lands 19 have different shapes, when viewed in plan, including a heart shape, a square shape, a triangular shape, a trapezoidal shape, an elliptical shape, and a rectangular shape. As shown in FIG. 4, the differently shaped lands 19 project upwardly and are exposed above the upper surface of the upper plate 3 through respective complementarily shaped holes 21 that are defined in the bottom of the recess 5.

As shown in FIGS. 3 and 4, the jigsaw puzzle toy also includes six rectangular blocks 23 comprising respective main bodies 25 and respective back plates 27 held against the main bodies 25. The rectangular blocks 23 can fit in the recess 5 of the game board 2. The main bodies 25 have respective cavities 29 defined in their upper surfaces, the cavities 29 being in the shapes of animals including a chick, a puppy, a duck, a pony, a calf, and a little bear, when viewed in plan. The back plates 27 have respective holes 31 defined therein which are complementary in shape to the lands 19 of the tubular movable members 17.

Four of the rectangular blocks 23 have, on at least one side thereof, laterally projecting teeth 33 of different shapes including a triangular shape, a rectangular shape, a semicircular shape, and a polygonal shape. The remaining two of the rectangular blocks 23, and also two of the rectangular blocks 23 which have the laterally projecting teeth 33 have, in at least one side thereof, laterally opening recesses 35 for receiving the teeth 33 therein. When the rectangular blocks 23 are fitted in the recess 5 of the upper plate 3, the holes 31 of the back plates 27 fit over the respective lands 19 projecting through the holes 21 of the game board 2, and the laterally projecting teeth 33 of the four rectangular blocks 23 are fitted respectively in the laterally opening recesses 35 of the adjacent four rectangular blocks 23.

As shown in FIG. 4, the jigsaw puzzle toy also includes figure blocks 37 having shapes, when viewed in plan, complementary to those of the cavities 29 in the respective main bodies 25 of the rectangular blocks 23. The figure blocks 37 also have pictures drawn thereon in relation to their shapes. The figure blocks 37 have respective lands 39 having shapes, when viewed in plan, complementary to those of the holes 31 defined in the respective back plates 27. Therefore, the figure blocks 37 can fit in their entity in the respective cavities 29, and the lands 39 thereof can also fit in the holes 31 in the back plates 27 when the rectangular blocks 23 are turned over.

The player can play with the jigsaw puzzle toy in different ways as described below.

According to one playing method, the rectangular blocks 23 are taken out and turned over, and their teeth 33 are fitted into the respective complementary recesses 35. Furthermore, the lands 39 of the figure blocks 37 are fitted respectively into the respective complementary holes 31 in the back plates 27 of the rectangular blocks 23, thereby completing a jigsaw puzzle combination.

Another playing process is that the holes 31 of the rectangular blocks 23 are fitted successively over the respective complementary lands 19 that project within the recess 5 of the game board 2 while allowing the teeth 33 to fit in the respective complementary recesses 35. Thereafter, the figure blocks 37 are fitted respectively into the complementary cavities 29 of the rectangular blocks 23, whereupon another jigsaw puzzle combination is completed.

According to still another playing practice, the rectangular blocks 23 are taken out, and their teeth 33 are fitted into the respective complementary recesses 35. Then, the figure blocks 37 are fitted respectively into the complementary cavities 29 of the rectangular blocks 23.

After the rectangular blocks 23 are fitted in the recess 5 of the game board 2 and the figure blocks 37 are fitted respectively into the complementary cavities 29 of the rectangular blocks 23, thus completing the jigsaw puzzle combination, the player can push any desired one of the figure blocks 37.

When the figure blocks 37 are pushed down by the player, the tubular movable members 27 are depressed downwardly by the figure blocks 37, thereby pushing the whistles 50 while compressing the corresponding bellows 47. Air is then forced from the bellows 47 into the whistles 50, causing the whistles to make sounds. The whistles 50 supported on the bellows 47 below the respective figure blocks 37 are constructed such that they produce sounds simulating cries of the animals which are represented by the shapes of the figure blocks 37. For example, when the figure block 37 shaped like a duck is pushed, the whistle 50 below the pushed figure block 37 produces a sound simulating a duck's cry.

Figure 6:
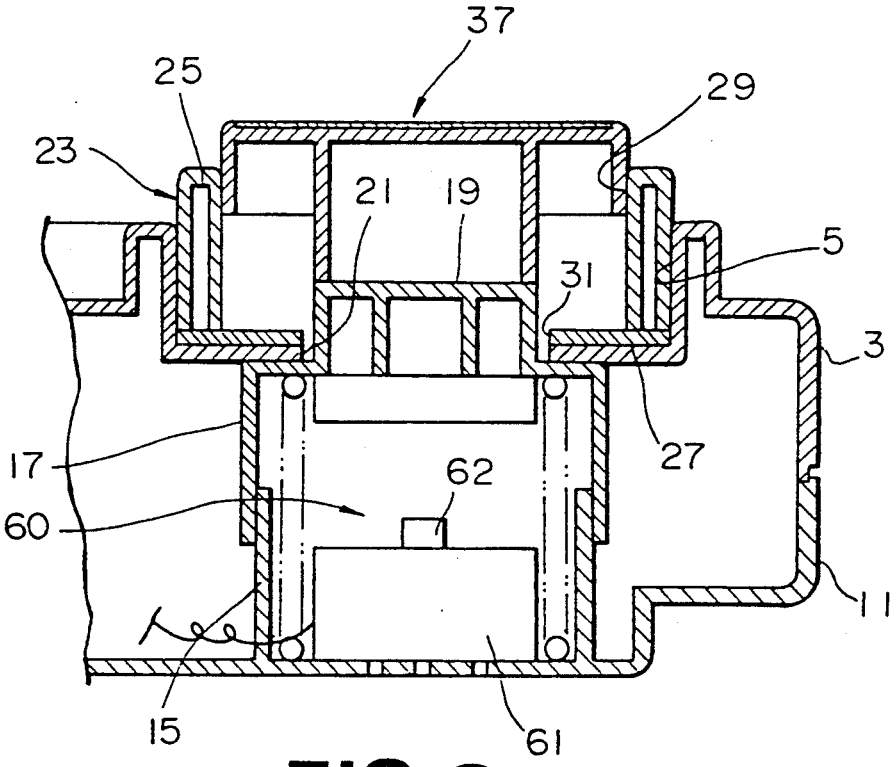
FIG. 6 is a view similar to FIG. 5, showing a modification which employs an electronic sound generator.

FIG. 6 shows a modification in which an electric sound generator 60 is positioned below each of the tubular movable members 17. The electronic sound generator 60 is of a known structure, as disclosed in Japanese Laid-Open Utility Model Publication No. 60-94288, for example. The electronic sound generator 60 comprises a switch button 62 projecting upwardly from a housing 61 disposed within the guide frame 15 below the tubular movable member 17. The switch button 62 can be depressed into the housing 61 against the resiliency of a resilient member (not shown) in the housing 61. When the figure block 37 is pushed downwardly by the player, the tubular movable member 17 is depressed through the rectangular block 23 to depress the switch button 62. The electronic sound generator 60 is activated when a terminal (not shown) on the inner end of the switch button 62 is brought into contact with another terminal (not shown) connected to an IC (not shown) and a sound generating unit (not shown) that are placed in the housing 61. The IC stores, as digital information, a sound such as a cry of an animal, related to the shape of the figure block 37 and/or the picture drawn on the figure block 37 that engages the tubular movable member 17 through the rectangular block 23. When the switch button 62 is pushed by the player 62, therefore, the stored digital information is read and supplied to the sound generating unit to enable the sound generating unit to produce the sound.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

I claim:

1. A jigsaw puzzle toy comprising:

a board;

a plurality of first projections projecting on an upper surface of said board and having first shapes, when viewed in plan;

a plurality of first blocks having first holes defined in surfaces thereof and having shapes complementary to said first shapes of said first projections for fitting engagement therewith, and second holes defined in other surfaces thereof different from said first holes when viewed in plan; and a plurality of second blocks having shapes complementary to said second shapes, when viewed in plan, for fitting engagement in said cavities, of said first blocks.

2. A jigsaw puzzle toy according to claim 1, wherein said second blocks have second projections having said first shapes.

3. A jigsaw puzzle toy according to claim 1, wherein each of said first blocks has, on a side thereof, at least one of a tooth or a recess, which is engageable with one of the tooth and the recess of another one of the first blocks.

4. A jigsaw puzzle toy according to claim 1, further including resilient members supporting said first projections, for allowing the first projections to be depressed vertically against the resilient members.

5. A jigsaw puzzle toy according to claim 4, further including sound generating means, disposed below said first projections, for generating sounds in response to the depression of said first projections.

6. A jigsaw puzzle toy according to claim 5, wherein said sound generating means comprise means for generating sounds corresponding to the shapes of said second blocks.

7. A jigsaw puzzle toy according to claim 1, wherein said board has a recess defined in an upper surface thereof, for allowing said first blocks to be fitted therein, said first projections being disposed in a bottom of said recess.

8. A jigsaw puzzle comprising a board with a first set of upward projections, a first set of blocks having on a surface recesses complementary to said first set of upward projections and having a second set of upward projections on a surface opposed to said surface with recesses, a platform having holes complementary in shape to the second set of upward projections on said first set of blocks, said second set of upward projections on said first set of blocks extending through their complementary holes in said platform.

9. A jigsaw puzzle according to claim 8 further comprising a second set of blocks having recesses in one surface thereof complementary to the upward projections of said first set of blocks.

10. A jigsaw puzzle according to claim 9 wherein said one surface of said second set of blocks have interfitting projections parallel to the plane in which said recesses are formed.

11. A jigsaw puzzle according to claim 10 wherein said second set of blocks have recesses in a surface opposed to said one surface, and a third set of blocks having shapes complementary to said last mentioned recesses.

* * * * *